US006517407B1

(12) United States Patent
Peters

(10) Patent No.: US 6,517,407 B1
(45) Date of Patent: Feb. 11, 2003

(54) THREE-DIMENSIONAL INTERACTIVE BOOK

(76) Inventor: Tim Peters, 23 Tiger Hill, Gladstone, NJ (US) 07934

( * ) Notice: Subject to any disclaimer, the term of this patent is extended or adjusted under 35 U.S.C. 154(b) by 0 days.

(21) Appl. No.: 09/915,828

(22) Filed: Jul. 26, 2001

(51) Int. Cl.[7] ..... A63H 33/38
(52) U.S. Cl. ..... 446/147; 446/149; 281/15.1
(58) Field of Search ..... 446/149–152, 446/147; 434/156, 176, 402, 404–405; 281/15.1, 29, 36–38; 283/63.1, 64; 40/495; D19/26, 28, 29; D21/156

(56) References Cited

U.S. PATENT DOCUMENTS

| | | | | | |
|---|---|---|---|---|---|
| 1,028,921 | A | | 6/1912 | Wagner | |
| 1,177,652 | A | * | 4/1916 | Robertson | |
| 2,489,240 | A | | 11/1949 | Meyer | 46/34 |
| 2,946,137 | A | | 7/1960 | Worth et al. | 35/35 |
| 2,959,872 | A | * | 11/1960 | Rodgers | |
| 3,658,365 | A | | 4/1972 | Greubel | 281/31 |
| 4,372,077 | A | * | 2/1983 | Balbuena | |
| 4,819,963 | A | | 4/1989 | Wolski | 281/15.1 |
| 4,832,648 | A | | 5/1989 | Theobald et al. | 446/72 |
| 4,930,693 | A | | 6/1990 | Schwab | 223/66 |
| 5,014,455 | A | * | 5/1991 | Desaderata | 40/539 |
| 5,356,295 | A | | 10/1994 | Grosz | 434/267 |
| D394,672 | S | * | 5/1998 | Allen et al. | D19/29 |
| 5,759,043 | A | * | 6/1998 | Craig | 434/247 |
| 5,762,573 | A | * | 6/1998 | Kennedy, III et al. | 473/570 |
| 5,915,729 | A | * | 6/1999 | Vap | 281/22 |
| 5,951,358 | A | | 9/1999 | Hilko et al. | 446/147 |
| 6,098,325 | A | * | 8/2000 | Goldman | 40/495 |
| 6,224,106 | B1 | * | 5/2001 | Murphy | 281/15.1 |
| D450,763 | S | * | 11/2001 | Fernandes et al. | D19/26 |
| 6,327,801 | B1 | * | 12/2001 | Witkowski | 40/306 |

* cited by examiner

*Primary Examiner*—Derris H. Banks
*Assistant Examiner*—Jamila Williams
(74) *Attorney, Agent, or Firm*—Mathews, Collins, Shepherd & McKay

(57) ABSTRACT

A three-dimensional interactive book includes a wheelfold sandwiched between front and rear covers. The front cover has illustrations on both the convex and concave surfaces of a three-dimensionally contoured element. The rear cover has a holographic element. The wheelfold has a wheel rotatably mounted between opposite front and rear panels. Primary pictorial elements on the wheel are selectively visible through a window on the front panel. A secondary pictorial element on the front panel is juxtaposed with the window. Selected surfaces, elements, and panels have text written thereon.

18 Claims, 2 Drawing Sheets

THREE-DIMENSIONAL INTERACTIVE BOOK

FIELD OF THE INVENTION

This invention relates to the field of books, and more particularly to an interactive three-dimensional book.

BACKGROUND OF THE INVENTION

Today's electronic multimedia educational tools are both informative and entertaining at the same time. These new devices and methods capture and hold attention with three-dimensional graphics, video, and audio however they require extensive support equipment to view. Conventional books fall short by comparison. The traditional prior art has countered this trend in several ways. Three-dimensional printed and stamped graphics have been included in books. Various toys and objects have been removably enclosed in cavities within the books. Some examples of three-dimensional books in the prior art are seen in the following U.S. patents:

Wolski, U.S. Pat. No. 4,819,963, discloses a combination book and three-dimensional sculpture.

Vap, U.S. Pat. No. 5,915,729, shows a book having an integrally formed shell in the shape of an object. The shape of the object corresponds to the text of the book. The shells are adapted to receive one or more removable parts.

Hilko, U.S. Pat. No. 5,951,358, discloses a combination toy vehicle having an internal book. Opening the toy vehicle reveals the internal book.

Grosz, U.S. Pat. No. 5,356,295, reveals an anatomical model having front and rear flaps and separate templates providing educational information.

While the prior art devices are instructive, none of them are truly user-interactive. Accordingly, there is a need to provide an educational book tool that will give the user a total learning experience, is interactive, will display a realistic 3-D view of the subject matter, without having loose parts that may become lost, while it is simple and rugged for long life.

SUMMARY OF THE INVENTION

In accordance with the present invention, there is provided a three-dimensional interactive book, comprising a front cover having an outer surface and an opposite inner surface. The front cover has a three-dimensionally contoured element. The book includes a rear cover having an outer surface and an opposite inner surface. A wheelfold is provided, having a wheel rotatably mounted between opposite front and rear panels. The front and rear panels each have an outer edge, and the panels are connected together along the outer edge. The wheel has a periphery, and a plurality of primary pictorial elements. The wheelfold has a window in one of the panels, and one of the primary pictorial elements is visible through the window. The wheelfold is sandwiched between the front and rear covers. Binding means is provided for binding the front cover, the rear cover, and the wheelfold together. The contoured element includes a convex surface adjacent the front cover outer surface and a concave surface adjacent the front cover inner surface, and illustrations on both the convex and concave surfaces. The wheelfold further comprises a notch in the outer edge of the front and rear panels, and serrations on the wheel periphery, the serrations being exposed along the notch. A secondary pictorial element on one of the panels is juxtaposed with the window. Thus, upon manually rotating the wheel by the serrations, the primary pictorial elements will be selectively aligned with the secondary pictorial element through the window. Selected surfaces, elements, and panels have text written thereon.

BRIEF DESCRIPTION OF THE DRAWING

A more complete understanding of the present invention may be obtained from consideration of the following description in conjunction with the drawing, in which.

DESCRIPTION OF THE PREFERRED EMBODIMENTS

Although the present invention is particularly well suited for depicting the human anatomy and shall be so described herein, it is equally well suited for depicting other anatomy as well as mechanical structures and devices.

Figure 1:
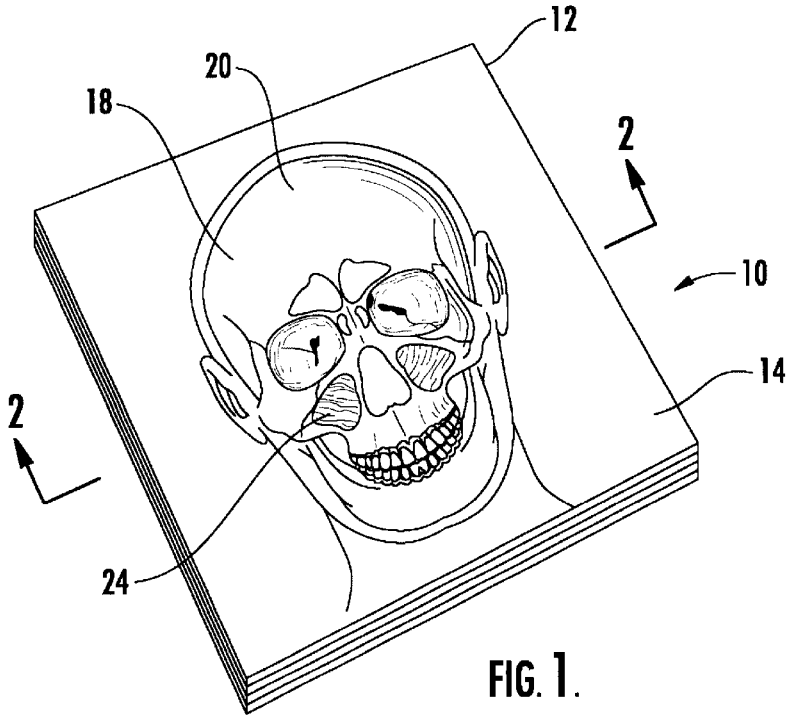
FIG. 1 is a front perspective view of a three-dimensional interactive book constructed in accordance with the invention.
Figure 2:
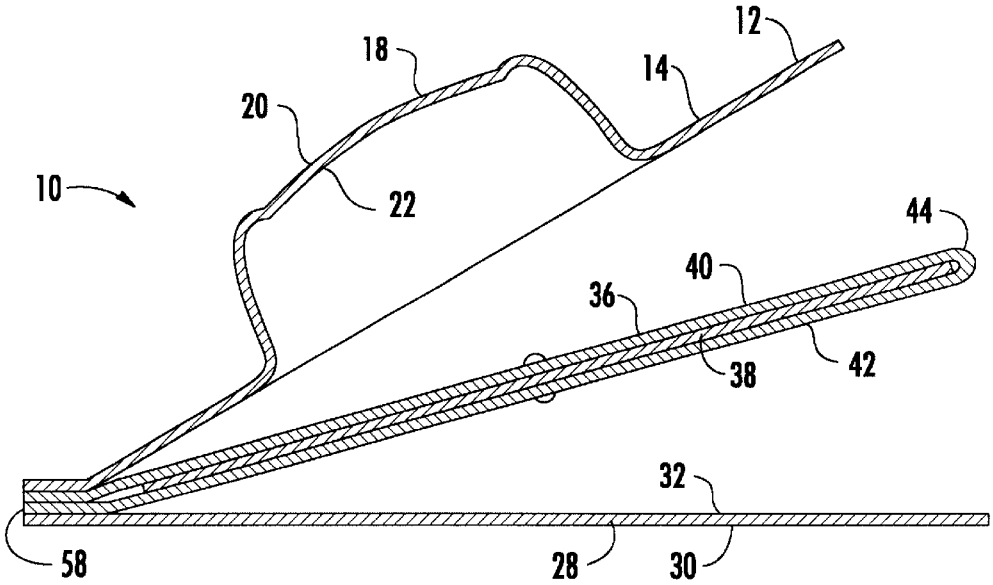
FIG. 2 is a cross-sectional view of the three-dimensional interactive book of FIG. 1, taken along lines 2—2 of FIG. 1.
Figure 4:
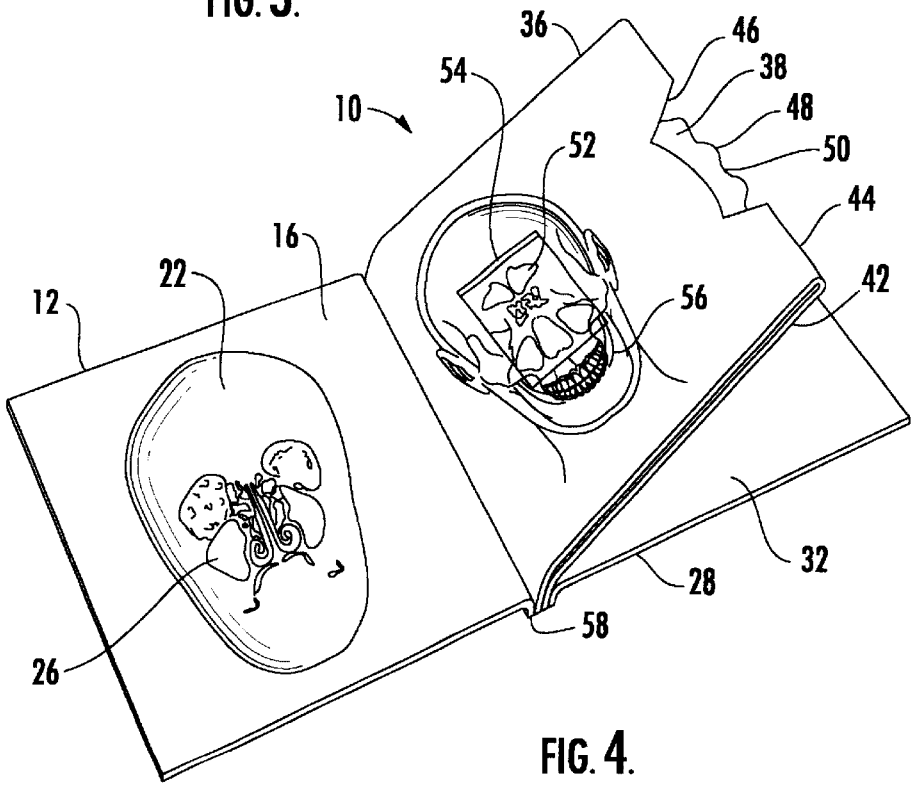
FIG. 4 is a perspective view of the three-dimensional interactive book of FIG. 1, showing the book in the open position.

Referring now to the drawing, a three-dimensional interactive book constructed in accordance with the invention is shown at 10. A front cover 12 has an outer surface 14 and an opposite inner surface 16. The front cover 12 has a three-dimensionally contoured element 18. As seen in cross-section in FIG. 2, the contoured element 18 has a convex surface 20 adjacent the front cover outer surface 14 and a concave surface 22 adjacent the front cover inner surface 16. The convex 20 and concave 22 surfaces each have illustrations which correspond to the contoured element 18. The contoured element convex surface 20 includes a first illustration 24 of human sinuses as viewed from the front, and is depicted in FIG. 1. The contoured element concave surface 22 includes a second illustration 26 of human sinuses as viewed from the rear, and is shown in FIG. 4.

Figure 3:
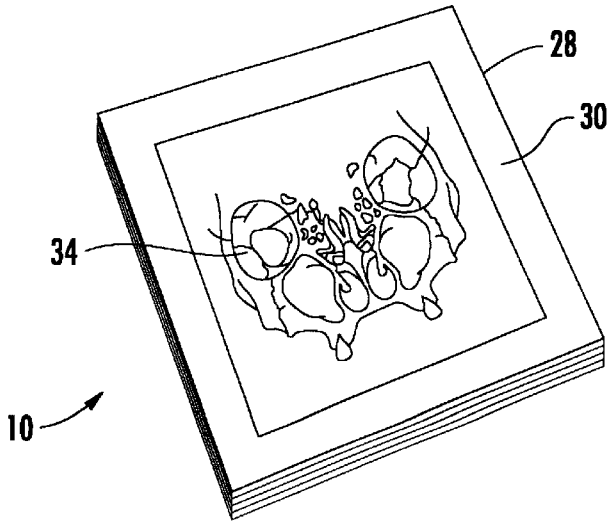
FIG. 3 is a rear perspective view of the three-dimensional interactive book of FIG. 1.

The book includes a rear cover 28 having an outer surface 30 and an opposite inner surface 32. In addition, the rear cover 28 has a holographic element 34, typically mounted on the outer surface 30, as shown in FIG. 3. The holographic element 34 may also be located on internal pages of the book.

A wheelfold 36 is sandwiched between the front 12 and rear 28 covers. The wheelfold 36 has a wheel 38 rotatably mounted between opposite front 40 and rear 42 panels. The front 40 and rear 42 panels each have an outer edge 44, and the panels 40 and 42 are connected together along the outer edge 44. There is a notch 46 in the outer edge 44 of the front 40 and rear 42 panels. The wheel 38 has a periphery 48, with serrations 50 on the wheel periphery 48, the serrations 50 being exposed along the notch 46. The wheel 38 has a plurality of primary pictorial elements 52, text, illustrations, or holographic images. The primary pictorial elements 52 typically will include four elements: a depiction of normal sinuses; a depiction of acute rhinosinusitis; a depiction of chronic rhinosinusitis; and a depiction of treatment of rhinosinusitis. One of the primary pictorial elements 52 is visible through a window 54 in one of the panels, usually the front panel 40, as shown in FIG. 4.

The wheelfold 36 includes a secondary pictorial element 56 on the front panel 40 juxtaposed with the window 54. The secondary pictorial element 56 is a depiction of a human head as viewed from the front, and includes a region of the head corresponding with the sinuses. The window 54 is disposed over the region of the head corresponding with the sinuses. Thus, upon manually rotating the wheel 38 by the serrations 50, the primary pictorial elements 52 will be selectively aligned with the secondary pictorial element 56 through the window 54.

Selected surfaces, elements, panels and covers have text 60 written thereon, as well as illustrations and graphics printed thereon. Binding means 58 is provided for binding the front cover, the rear cover, and the wheelfold together.

A method is disclosed of displaying information three-dimensionally and interactively within the context of a book. The method comprises the steps of: mounting a three-dimensionally contoured element 18 on a front cover 12 having an outer surface 14 and an opposite inner surface 16; juxtaposing a convex surface 20 of the contoured element 18 adjacent an outer surface 14 of the front cover 12 and a concave surface 22 of the contoured element 18 adjacent an inner surface 16 of the front cover 12; illustrating the convex 20 and concave surfaces 22; mounting a holographic element 34 on a page of the book such as the rear cover 28 having an outer surface 30 and an opposite inner surface 32; sandwiching a wheelfold 36 between the front 12 and rear 28 covers; mounting a wheel 38 rotatably between opposite front 40 and rear 42 panels; connecting the panels together along an outer edge 44; illustrating the wheel 38 with a plurality of primary pictorial elements 52; cutting a window 54 in one of the panels; displaying one of the primary pictorial elements 52 through the window 54; and binding the front cover 12, the rear cover 28, and the wheelfold 36 together.

Further steps comprise: depicting human sinuses as viewed from the front in the contoured element convex surface illustration 24; and depicting human sinuses as viewed from the rear in the contoured element concave surface illustration 26.

Still further steps comprise: notching the outer edge 44 of the front 40 and rear 42 panels; serrating the wheel 38 peripherally, and exposing the serrations 50 along the notch 46; juxtaposing a secondary pictorial element 56 with the window 54 on the front panel 40; and rotating the wheel 38 manually by the serrations, and aligning the primary pictorial elements 52 selectively with the secondary pictorial element 56 through the window 54.

Yet further steps comprise: depicting normal sinuses in the primary pictorial elements 52; depicting acute rhino sinusitis in the primary pictorial elements 52; depicting chronic rhino sinusitis in the primary pictorial elements 52; and depicting treatment of rhino sinusitis in the primary pictorial elements 52.

Additional steps comprise: depicting a human head as viewed from the front in the secondary pictorial element 56; and positioning the window 54 over a region of the head corresponding with the sinuses.

Another step comprises writing text on selected surfaces, elements, and panels.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications, which will come within the scope of the appended claims, is reserved.

What is claimed:

1. A three-dimensional interactive book, comprising:

a front panel having an outer surface and an opposite inner surface, the front panel having a three-dimensionally contoured element, the three-dimensionally contoured element having a convex surface adjacent the front panel outer surface, a concave surface adjacent the front panel inner surface, and illustrations on both the convex and concave surfaces;

a rear panel having an outer surface and an opposite inner surface;

a wheelfold having a wheel rotatably mounted between opposite front and rear panels, the front and rear panels each having an outer edge, the front and rear panels being connected together along the outer edge, the wheel having a periphery, the wheel having a plurality of primary information elements, the wheelfold having a window in one of the front and rear panels, one of the primary information elements being visible through the window, the wheelfold being sandwiched between the front and rear panels; and binding means for binding the front panel, the rear panels, and the wheelfold together.

2. The three-dimensional interactive book as recited in claim 1 wherein the primary information elements are pictorial elements.

3. The three-dimensional interactive book as recited in claim 1 wherein the primary information elements are holographic images.

4. The three-dimensional interactive book as recited in claim 1 further comprising a holographic image on the rear panel.

5. The three-dimensional interactive book as recited in claim 1, wherein the wheelfold further comprises:

a notch in the outer edge of the front and rear panels;

serrations on the wheel periphery, the serrations being exposed along the notch; and a secondary pictorial element on the one of the front and rear panels juxtaposed with the window, so that upon manually rotating the wheel by the serrations, the primary pictorial elements will be selectively aligned with the secondary pictorial element through the window.

6. The three-dimensional interactive book as recited in claim 1, wherein selected surfaces, elements, and panels have text written thereon.

7. A three-dimensional interactive book, comprising:

a front panel having an outer surface and an opposite inner surface, the front panel having a three-dimensionally contoured element, the three-dimensionally contoured element having a convex surface adjacent the front panel outer surface and a concave surface adjacent the front panel inner surface, the convex and concave surfaces both having illustrations thereon;

a rear panel having an outer surface and an opposite inner surface;

a wheelfold having a wheel rotatably mounted between the front and rear panels, the front and rear panels each having an outer edge, the front and rear panels being connected together along the outer edge, the wheel having a periphery, the wheel having a plurality of primary information elements, the wheelfold having a window in one of the front and rear panels, one of the primary information elements being visible through the window, the wheelfold being sandwiched between the front and rear panels; and binding means for binding the front panel, the rear panel, and the wheelfold together.

8. The three-dimensional interactive book as recited in claim 7 wherein the primary information elements are pictorial elements.

9. The three-dimensional interactive book as recited in claim 7 wherein the primary information elements are holographic images.

10. The three-dimensional interactive book as recited in claim 7 further comprising a holographic image on the rear panel.

11. The three-dimensional interactive book as recited in claim 7, wherein:

the three-dimensionally contoured element convex surface includes a first illustration of human anatomy as viewed from the front; and the three-dimensionally contoured element concave surface includes a second illustration of human anatomy as viewed from the rear.

12. The three-dimensional interactive book as recited in claim 8, wherein: the wheelfold further comprises:

a notch in the outer edge of the front and rear panels;

serrations on the wheel periphery, the serrations being exposed along the notch; and a secondary pictorial element on the front panel juxtaposed with the window, so that upon manually rotating the wheel by the serrations, the primary information elements will be selectively aligned with-the secondary pictorial element through the window.

13. The three-dimensional interactive book as recited in claim 12, wherein selected surfaces, elements, and panels have text written thereon.

14. A method of displaying information three-dimensionally and interactively within the context of a book, the method comprising the steps of:

mounting a three-dimensionally contoured element on a front panel having an outer surface and an opposite inner surface;

juxtaposing a convex surface of the contoured element adjacent an outer surface of the front panel and a concave surface of the contoured element adjacent an inner surface of the front panel;

illustrating the convex and concave surfaces;

sandwiching a wheelfold between the front and rear panels;

mounting a wheel rotatably between opposite front and rear panels;

connecting the front and rear panels together along an outer edge;

illustrating the wheel with a plurality of primary pictorial elements;

cutting a window in one of the front and rear panels;

displaying one of the primary pictorial elements through the window; and binding the front panel, the rear panel, and the wheelfold together.

15. The method as recited in claim 14, further comprising the steps of:

mounting a holographic element.

16. The method as recited in claim 14 wherein the convex and concave surfaces correspond to a representation of anatomy.

17. The method as recited in claim 14, further comprising the steps of:

notching the outer edge of the front and rear panels;

serrating the wheel peripherally, and exposing the serrations along the notch;

juxtaposing a secondary pictorial element with the window on the front panel; and rotating the wheel manually by the serrations, and aligning the primary pictorial elements selectively with the secondary pictorial element through the window.

18. The method as recited in claim 17, further comprising the step of writing text on selected surfaces, elements and rear panels.

* * * * *